US006481714B1

(12) United States Patent
Jacobs

(10) Patent No.: US 6,481,714 B1
(45) Date of Patent: Nov. 19, 2002

(54) MEDIEVAL CASTLE BOARD GAME

(76) Inventor: Mark A. Jacobs, 720 Gardenia La., Bartlett, IL (US) 60103

( * ) Notice: Subject to any disclaimer, the term of this patent is extended or adjusted under 35 U.S.C. 154(b) by 0 days.

(21) Appl. No.: 09/551,325

(22) Filed: Apr. 18, 2000

(51) Int. Cl.[7] ..... A63F 3/00

(52) U.S. Cl. ..... 273/236; 273/241; 273/243; 273/255; 273/262

(58) Field of Search ..... 273/236, 241, 273/242, 243, 287

(56) References Cited

U.S. PATENT DOCUMENTS

| | | | | |
|---|---|---|---|---|
| 2,453,907 | A | | 11/1948 | Hare et al. |
| 3,399,895 | A | | 9/1968 | Beach |
| 3,674,274 | A | | 7/1972 | Schur |
| 3,692,310 | A | | 9/1972 | Martin |
| 3,767,201 | A | | 10/1973 | Harper et al. |
| 4,062,545 | A | * | 12/1977 | Witney |
| 4,081,183 | A | | 3/1978 | Urban |
| 4,373,731 | A | * | 2/1983 | Whiteman |
| 4,415,160 | A | * | 11/1983 | Lamb |
| 4,477,080 | A | * | 10/1984 | Baker ..... 273/241 |
| 4,573,688 | A | | 3/1986 | Grimes |
| 4,861,040 | A | * | 8/1989 | Peterson |
| 4,883,278 | A | | 11/1989 | Scott |
| 4,927,157 | A | | 5/1990 | Riihiluoma et al. |
| 5,456,472 | A | | 10/1995 | Goodman |
| 5,626,340 | A | | 5/1997 | Phillips |

OTHER PUBLICATIONS

Talisman the Magic Quest GameOct. 1984.*

* cited by examiner

*Primary Examiner*—Benjamin H. Layno
*Assistant Examiner*—Vishu K Mendiratta
(74) *Attorney, Agent, or Firm*—Thomas R. Vigil; Welsh & Katz, Ltd.

(57) ABSTRACT

The game kit for a board game comprises a game board having three levels and at least one stairway between the three levels, at least one die, at least two fighter pieces and a unique battle card for each piece. The game kit is used to play a medieval castle board game comprising the steps of: rolling the die to determine which player goes first; each player then sequentially rolling the die to determine the number of spaces the player can move his fighter piece on the board; and sequentially moving the fighting piece around the board until it is positioned to do battle with another fighting piece or it reaches a sanctuary.

19 Claims, 2 Drawing Sheets

MEDIEVAL CASTLE BOARD GAME

BACKGROUND OF THE INVENTION

1. Field of the Invention

The present invention is directed to a multi-level medieval castle board game using a multi-level game board and wherein each player is the commander of an army of various Fighters such as knights, dragons, and wizards. The first player to get a predetermined number of Fighters into the center of a medieval castle (Sanctuary) is the winner. The Fighters travel around the castle in honor of their King to conquer and destroy all in their path. They must reach the Sanctuary in order to take over the castle ensuring that their King will reign over the kingdom.

2. Description of the Prior Art

Heretofore, a variety of multi-level board games have been proposed. Examples of these previously proposed non-analogous board games are disclosed in the following non-analogous U.S. patents:

| U.S. Pat. No. | Patentee |
|---|---|
| 2,453,907 | Hare et al. |
| 3,399,895 | Beach |
| 3,674,274 | Schur |
| 3,692,310 | Martin |
| 3,767,201 | Harper et al. |
| 4,081,183 | Urban |
| 4,415,160 | Lamb |
| 4,573,688 | Grimes |
| 4,861,040 | Peterson |
| 4,883,278 | Scott |
| 4,927,157 | Riihiluoma et al. |
| 5,456,472 | Goodman |
| 5,626,340 | Phillips |

SUMMARY OF THE INVENTION

Figure 1:
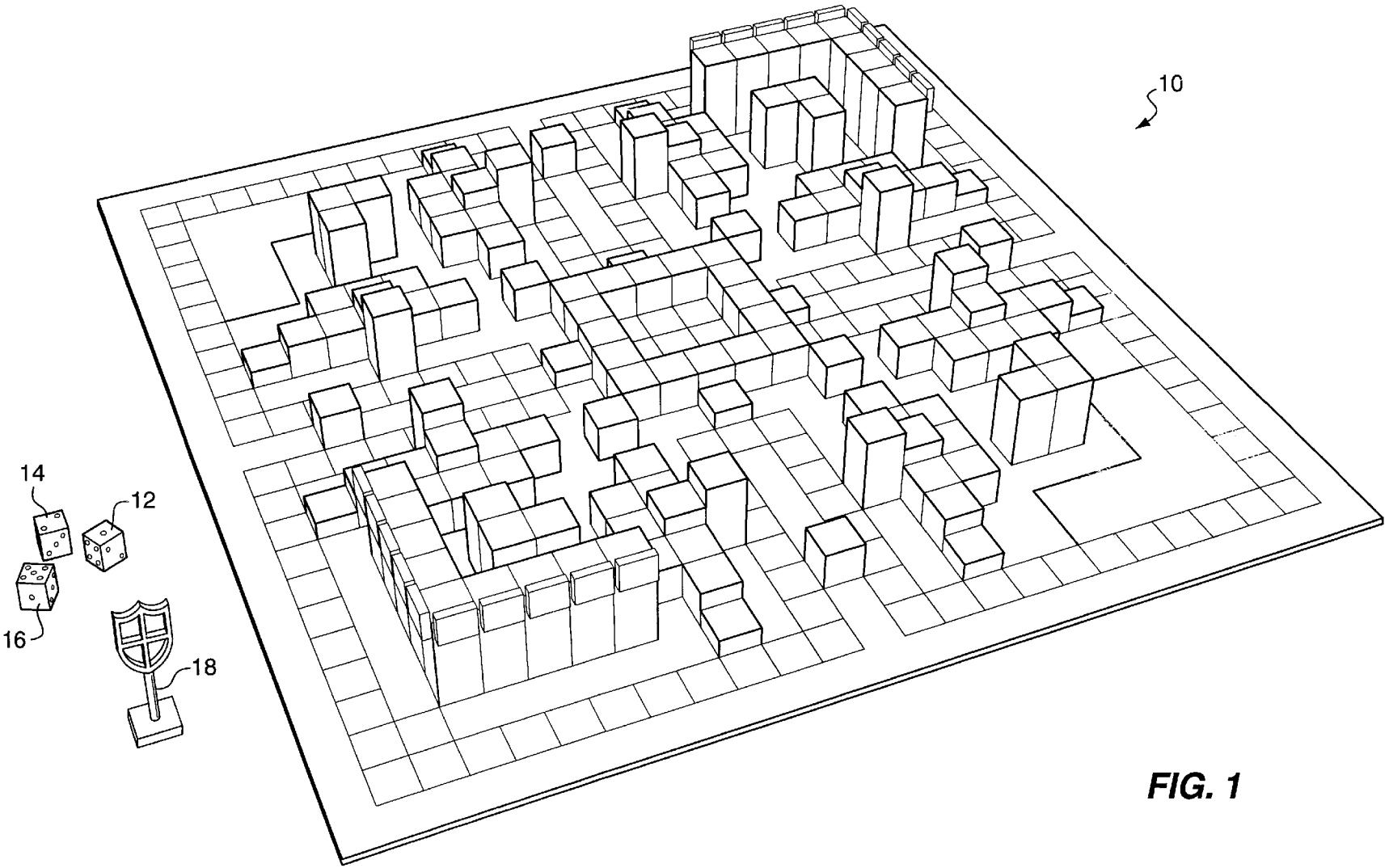
FIG. 1 is a perspective view of the game board, three die and one game piece.

According to the present invention there is provided a game kit for a board game comprising a game board having three levels and at least one stairway between the three levels, at least one die, at least two fighter pieces and a unique battle card for each piece. The game kit is used to play a medieval castle board game comprising the steps of: rolling the die to determine which player goes first; each player then sequentially rolling the die to determine the number of spaces the player can move his fighter piece on the board; and sequentially moving the fighting piece around the board until it is positioned to do battle with another fighting piece or it reaches a sanctuary.

DESCRIPTION OF THE PREFERRED EMBODIMENT(S)

While some elements of the medieval castle board game are illustrated in the drawings, i.e., the board 10, three die

12, 14 and 16, one fighter piece 18 and one battle card 20, it will be understood the game kit includes a number of elements and printed cards or sheets which are listed below:

1 Game Board
1 Red Dice
2 White Dice
1 Dice Roll Reference Card
1 Card of Doom (Fate Card)
1 Card of Happiness (Fate Card)
1 Card of Doom Reference Sheet
1 Card of Happiness Reference Sheet
1 Magical Spells Reference Sheet
1 Game Instructions
4 King Pieces (1 black, 1 blue, 1 red, 1 white)
16 Fighters with Associated Battle Cards
50 Battle Card Pegs
16 Snap-On Fighter Bases (4 black, 4 blue, 4 red, 4 white)

Figure 2:
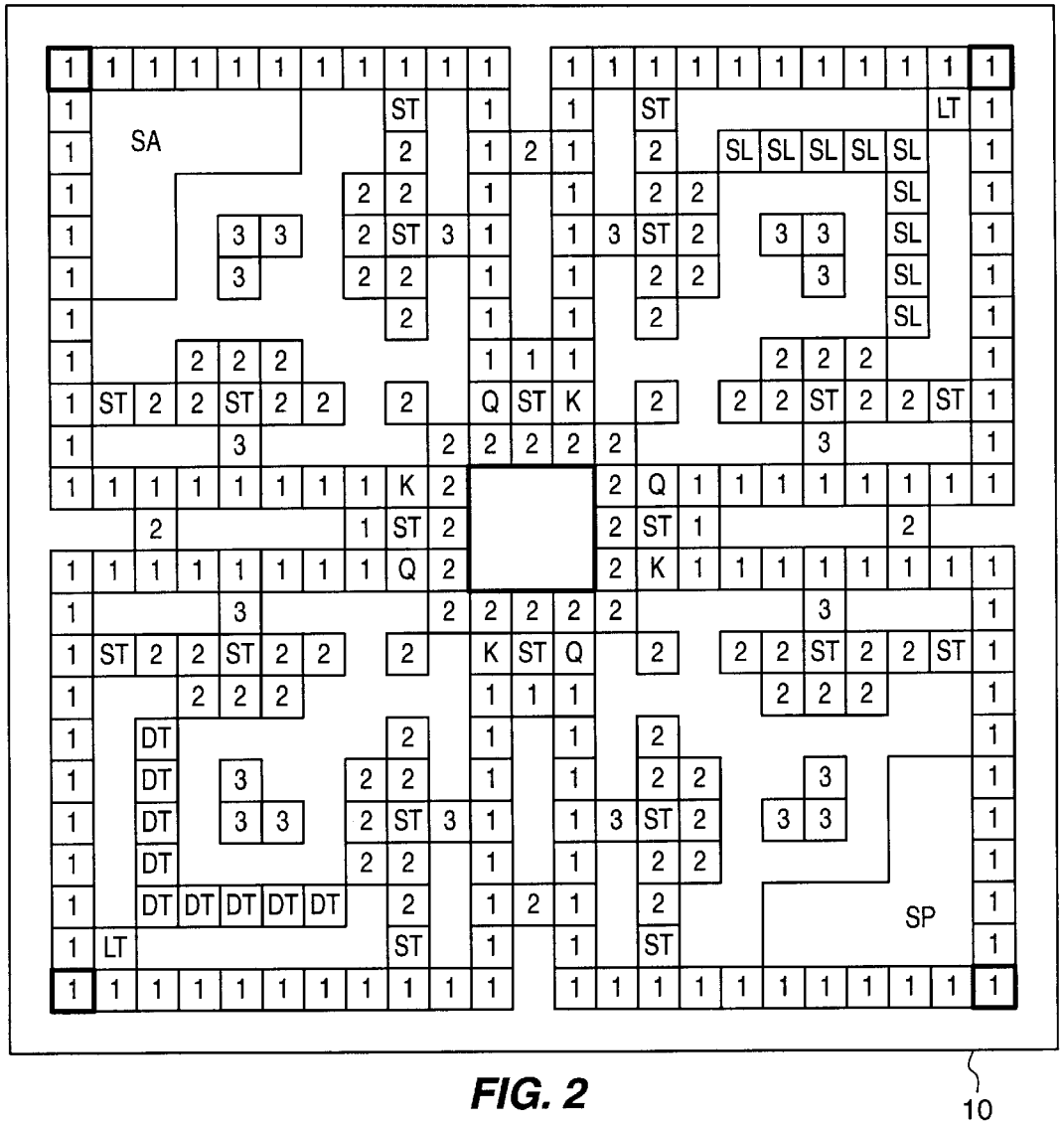
FIG. 2 is a top plan view of the game board shown in FIG. 1 and shows special locations on the board and the three different levels of the board.

The board layout is shown in FIG. 2. The numbers, 1 through 3, in the layout represent the levels. The other abbreviations shown in the layout are as follows:

'K' represents King's Position
'Q' represents Queen's Position
'ST' represents Stairway
'DT' represents Double Trouble
'SA' represents Shark Attack
'SL' represents Spider Lair
'SP' represents Snake Pit
'LT' represents Lucky Toad The following positions on the board have special meanings. They will be described in greater detail in the How to Play section. For now these positions are identified as follows with reference to the board layout.

The outlined level one position in the upper left corner of the board layout represents the position where a fighter is placed when it escapes from the Shark Attack.

The outlined level one position in the lower right corner of the board layout represents the position where a fighter is placed when it escapes from the Snake Pit.

The large outlined square in the center of the game board represents Sanctuary.

The level two positions forming a square surrounding Sanctuary is referred to as the Inner Square.

The outlined level one positions in the upper right and lower left corners of the board layout represent the position where a fighter must be located to replenish Health Points from a Lucky Toad.

The square game board 10 is made up of 25 by 25 small squares for a total of 625 small squares. Each small square is 1 inch by 1 inch. The total board size is therefore 25 inches by 25 inches. Level one of the board game is flat. Level two is one inch high off the flat board surface, and level three is two inches high off the flat board surface.

The general instructions for playing the game are as follows:

The game is designed for between two to eight players, however, the initial supplies provided are intended for up to four players. The board layout represents a multi-level castle. Fighters, e.g., fighter piece 18 may only move up or down the levels through the stairways.

At times, players will need to roll the die to determine the highest roller. Whenever a tie occurs between one or more players, a tie breaker roll should be performed between the tied players until the highest roller is determined. This also applies when rolling the die for the lowest roll.

Each player begins with four Fighters and one King. The first player to get two of the four Fighters into Sanctuary takes over the castle and therefore wins the game.

An alternate way to play the game is to change the number of Fighters each player begins with, or change the number of Fighters needed to reach Sanctuary to win the game. Different combinations will alter the length of the game and the level of strategy. A player can experiment with different numbers to determine a preferred way of playing the game. Additional fighter pieces can be used to increase the beginning army sizes, or can be used as Mercenaries. If desired, additional fighter pieces can be purchased since the game only comes with enough Fighters for four players.

Each player begins by rolling the die to determine who gets to choose their first fighter. The highest roller goes first. Choosing Fighters should be done carefully depending on the player's strategy. The Fighters have different strengths and weaknesses. All of the Fighters should be displayed along with their cards for players to select. Players continue selecting Fighters in a clockwise order until each player has the predetermined number of Fighters (four) selected for their army. Each player also chooses a King and same colored fighter bases from one of the available colors (black, blue, red, and white). The fighter bases, not shown, snap onto the base of the Fighters to represent which player and King they belong to.

The player who went last in choosing Fighters gets to now choose their Starting Position on the board, and will get to go first when the game begins. Moving clockwise, each player will choose one of the eight Starting Positions by placing their Kings in one of the King's or Queen's Positions. The Starting Position is the level one position on the game board directly in front of the player's King that determines the Starting Position where a player's Fighters are put In Play. Refer to the Board Layout shown in FIG. 2. to identify the King's and Queen's Positions on the board. If the player's King is in the King's Position, the Fighters move clockwise around the game board. If the player's King is in the Queen's Position, the Fighters move counter-clockwise around the game board. The game is now ready to begin with each player taking turns in clockwise order.

If more than four players wish to play, this can be achieved by sharing the stairways leading to the Inner Square. For example, two players can share a stairway by one of them placing their King in the King's Position and the other player placing their King in the Queen's Position. This also implies that the two players will be traveling in opposite directions around the game board since these positions represent the player's direction.

At the beginning of the game, each player places one of their Fighters into their Starting position.

Turns are taken sequentially. On each player's turn, they will begin by rolling a single die. Player's may only move one fighter of their choice (belonging to them) during a turn. This fighter will be referred to as the Chosen Fighter. The following actions may be taken based on the roll of the die:

One or Two

The Current Player has the option of setting a fighter In Play by placing it in the Starting Position located in front of their King, or moving a fighter that is already In Play the number of spaces shown on the die. One of these options must be done if possible. Only one fighter can reside in the Starting Position at a time, therefore, a fighter occupying this position must be moved during a turn before another fighter can be put In Play.

Lucky Three

Move a fighter that is In Play three spaces if possible. Since threes are lucky, take another turn. This turn is like the beginning of any other turn, and, therefore, the die roll can apply to a new fighter.

Optional Four

Move a fighter that is In Play four spaces if possible. Since fours are optional, you can choose to not move any Fighters even if they can move four spaces.

Fate Five

Move a fighter that is In Play five spaces if possible. Either the Card of Happiness or the Card of Doom will now determine the fighter's fate. Roll a single die to determine which card holds your fate. The number rolled represents the column on the card. Columns one through three appear on the Card of Happiness and columns four through six appear on the Card of Doom. Next roll two dice to determine the row underneath that column (represented by the sum of the two dice).

Perform the fate that is displayed next to the row number. Refer to the fate descriptions in the Card of Happiness or Card of Doom sections. A player must be careful which fighter is chosen to move five spaces, because the player may be sending the fighter to its doom.

Six

Move a fighter that is In Play six spaces if possible. Otherwise, this roll may be used to place a fighter into Sanctuary if the fighter has entered the Inner Square surrounding Sanctuary. This is also a common roll needed to get Fighters out of a majority of the traps.

The above die rolls are displayed on a reference card included with this game for easy reference. The player will probably remember what the numbers represent after playing a few times, and will no longer need the card. Note that a fighter can only be placed into the Starting Position if the player rolls a one or a two on the die during their turn.

The fighters can be moved on three levels. The three levels exist on the board for the Fighters to move on. Level one is the white marble walkway existing on the flat surface of the board. Level two is the level that is approximately one inch in height off the surface of the board. Level three is the level that is approximately two inches in height off the surface of the board. Each level has its own advantages and disadvantages. Level one is the longest distance around the board but there is no jumping involved so a fighter can always move. In comparison, level three is the shortest distance around the board, but there are long jumps that require more difficult and exact die rolls. Only the stairs can be used to move up or down levels, so a fighter cannot move if they do not have enough die movements to make the jump across to the other side. Therefore, the higher the level, the shorter the distance around the board, but also the more difficult it is to get a die roll that will allow you to move the fighter.

At times, the player may not be able to move any Fighters at all due to none being In Play. The player must move a fighter the number of spaces shown on the die if possible even if it means moving the fighter backwards, unless an optional four was rolled on the die.

Fighters can pass other Fighters up when moving spaces, but cannot land in a position occupied by another fighter unless they battle for the position and win. Battles will be covered later in this document.

Fighters can move up or down stairways at any time they pass by them as they venture through the castle, except to enter the Inner Square. Fighters can only use the stairway next to their King to move up to the Inner Square. Kings guard these entrances and only allow their own Fighters to enter.

The fighter cannot move both forwards and backwards in a single move. This means a fighter cannot land in the same space twice when moving.

The fighter cannot move backwards past their Starting Position regardless of castle level. They must travel around the game board to get to the level one position directly next to the Starting Position, and then continue up the stairway onto the Inner Square surrounding Sanctuary. A fighter can go past their Starting Position moving forwards after traveling around the board, but this will require them to go completely around the board again before they can move up their stairway leading to Sanctuary.

A fighter can exit the Inner Square by going down any of the four stairways but can only return through their own stairway.

A player can only move a fighter the number of spaces shown on the die to a position that is on the same level, unless the fighter is traveling up or down a stairway.

Jumps are only allowed on levels two and three. Fighters can only jump across to the same level, cannot jump diagonally, and can only make the jump if they have the correct die movements to land in a position on the same level. The number of die movements required to make the jump is the number of spaces it would take to move the fighter across to the other side. For example, all jumps on level three require four die movements. Note that some jumps are prevented due to castle walls blocking the jump.

Once a fighter reaches the Inner Square the player simply needs a die roll of six to place the fighter into Sanctuary. Fighters in Sanctuary are considered finished and will remain there throughout the game.

After the Current Player has completed their turn by moving a fighter and taken any actions in the fate cards if needed, the player may choose to battle. The player can have a fighter battle any of the Fighters of opposing players as long as the opposing Fighters are within the range of at least one weapon on the attacking fighter's battle card. The range is the distance one fighter is from the other, or the number of movement points that it would take for a fighter to move to land in the space occupied by the opposing Fighter. For example, a range of +1 indicates that the Fighters are in positions on the board right next to each other. Ranges can apply to positions forwards and backwards from the attacking fighter.

Multiple battles can be fought before the Current Player ends their turn. Only one battle can be fought at a time. A single fighter can battle multiple opposing Fighters as long as they are all within range.

The battle begins with the Current Player rolling the die against their fighter's battle card to determine the weapon used. If the range of the weapon used is within the range between the Fighters, then the attack was successful. The damage caused by the weapon is then subtracted from the defending fighter's Health Points. The full amount of damage is not taken from the defending fighter's Health Points if the defending fighter is protected by armor or a protection spell. The armor number on the defending fighter's battle card reduces the damage points. If the fighter has a protection number, this is also deducted from the damage taken. The two players then continue to take turns rolling the die against the fighter's battle cards until the battle ends.

The battle ends when one of the fighter's Health Points drops below zero, or the attacking fighter misses. If a fighter's Health Points drop below zero, the fighter is considered dead and is taken Out of Play. Fighters taken Out of Play can be brought back In Play by starting over again. Their Health Points get reset and they do not lose any of their upgrades.

If an attacking fighter misses on their turn (the defending fighter is out of range from the weapon rolled), the defending fighter may choose to end the battle, or strike back since it is now their turn. In other words, whenever one player's fighter misses, the other player has the option to cancel the current battle. Of course, the battle could always resume on the next turn if the Fighters are still within range of each other. Once the battle is completed, it cannot be restarted again until another turn.

Note that if a player wishes to move their fighter to a position that is already occupied by an opposing fighter, then the attacking fighter must win the battle by Defeating the opposing fighter before moving to that position. This is considered a range of +0 on the battle cards so all attacks will be a hit (no misses).

Figure 3:
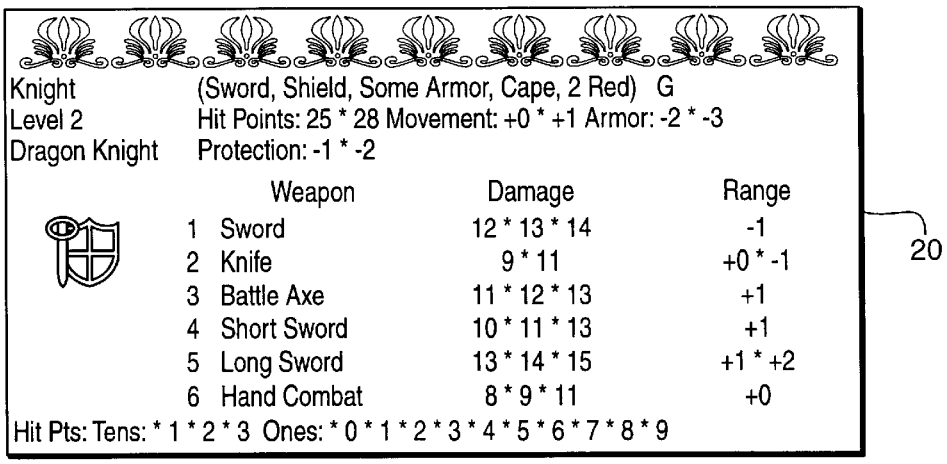
FIG. 3 is a plan view of a battle card used in the playing of the medieval castle board game of the present invention.

Each fighter or fighter piece (army unit) has a battle card 20 (FIG. 3) associated with it. The battle card contains information on the fighter's characteristics and abilities for both battle and movement. The battle card for a fighter is referred to whenever the fighter is moved or goes into battle. The various features that may appear on a battle card 20 are listed below in detail and some of them are shown on the battle card 20 illustrated in FIG. 3.

Battle Card Features

Army Unit Description

The army unit description is displayed in parenthesis. It describes the physical appearance of the army unit such as what the unit is carrying or wearing. This is commonly weapons, shields, helmets, armor, capes, etc. Also, the number and color of any gems are listed at the end of the description.

Army Unit Category

Directly to the right of the army unit description is a letter representing the army unit category. The possible categories are as follows: E=Evil, G=Good, M=Magic, N=Neutral.

Army Unit Type

The army unit type is the type of fighter. This is a general category for Fighters that have common characteristics. Examples of common army unit types are barbarians, dragons, knights, spirits and wizards.

Army Unit Level

The army unit level ranges from level one through level four. This level reflects the overall abilities of the fighter. Level one is the lowest level and represents a weaker less experienced fighter. In comparison, a level three fighter is more experienced or stronger which commonly gives them more movement points, more Health Points, more damage, etc. There is only one level four Fighter, the spirit Knight Mare.

Army Unit Name

The army unit name is a more specific name or classification given to the fighter. For example there are many Fighters that are knights. The army unit name further breaks this down into the specific type of knight that they are. For example, a knight could be a dragon knight, holy knight, mace knight, etc. Each of these knights have unique characteristics. A dragon knight is skilled at fighting dragons, a holy knight has additional protection, and a mace knight is skilled in battling with a mace as a weapon.

Hit Points (also known as Health Points)

Refer to the definition of Health Points described in the Glossary section.

HP Indicator

The HP Indicator is used to track the remaining Health Points that a fighter has as they get into battles. Fighters start out with their fully specified number of Health Points available each time they are put In Play. Up to two pegs may be needed to track the Health Points on a card. One peg for the tens position and one peg for the ones position. For example, a fighter with 32 Health Points would have a peg in the hole located to the left of the three in the tens section representing the 30. The other peg would be placed in the hole to the left of the two in the ones section representing the 2. As the fighter loses Health Points in battle, the pegs should be adjusted accordingly to track the remaining Health Points. Once a fighter drops below ten Health Points, only one peg is needed for the ones section. Once a fighter drops below one hit point, the fighter is Defeated in battle and taken Out of Play.

Movement

Movement points are always indicated as a positive number because it is the number that could be added to the roll of the die when moving the fighter. For example, if the player rolled a three, the fighter would move three spaces. The fighter can remain in this position or continue to move the number of movement points if desired. If the player chooses to move the fighter the extra movement points, all movement points must be used. This means a fighter cannot land in the same space twice when moving. These movement points do not effect the consequences of the die roll though. For example a die roll of three still means the player gets to roll again due to the lucky three rule. Movement points only effect the number of spaces the fighter moves. If a player forgets to add movement points to a fighter during a turn, then those movement points are lost.

Armor

Armor points are always indicated as a negative number because it is the number that is subtracted from the damage points against the fighter during battle. A higher negative number represents more armor and therefore absorbs more of the damage that would have been inflicted. In general armor points are given to the fighter for wearing some armor (1 point) or full armor (2 points), helmet (1 point), shield (1 point). Some Fighters may have armor points due to tough skin, scales, etc.

Additional Skills

Several other unique features may appear for a fighter with specific skills. For example, the Dragon Knight has an added feature of Dragon Damage. These damage points would be added to the damage points done by a weapon, whenever the Dragon Knight battles a dragon. Some of the additional features relate to the army unit category. For example, a fighter may have additional protection against Fighters categorized as Evil. There are also unique skills for Fighters with magical powers or spells. Refer to the Magical Spells section for a description of these skills.

Weapon Usage

The battle cards have rows numbered one through six, which are referenced during battle. The roll of the die determines which row is selected. In that row is the weapon name, damage caused by the weapon, and range of the weapon represented by the columns. For example, if the player rolls a three on the sample battle card for the Dragon Knight, the weapon used is a Battle Axe which causes 11 points of damage at a range of +1.

Weapon

The six weapons listed are the weapons that the fighter has available to them to use in battle. Sometimes one or more of the weapons may be listed multiple times meaning that the fighter uses these weapons more often, or is only skilled in a few weapons.

Damage

Each weapon has a number of damage points associated with it. The damage is the amount of points to be deducted from the opposing fighter's Health Points when that weapon is used. Not all of the damage may be deducted if the other fighter has some armor or protection points. Damage is usually higher for weapons that are more powerful, or the fighter is more skilled at using. The strength of the fighter may also add to the damage caused by a weapon that could cause a variance when compared to other Fighters using the same weapon. Damage is only applied if the fighter is within range of the other fighter.

Range

Each weapon has a number that represents the range of the weapon. The range is the number of movement points that it would take for a fighter to move to land in the space occupied by the opposing fighter. For example, a range of +1 indicates that the Fighters are in positions on the board right next to each other. Ranges can apply to positions forwards and backwards from the attacking fighter. If the weapon indicated by the roll of the die is not within range of the other fighter, then the attacking fighter missed.

Upgrading Battle Cards

The holes on the battle cards appear to the left of values that an item can be upgraded to. For example, the sample battle card for the Dragon Knight shows that the fighter has 30 Health Points. The 30 is followed by a hole to the right of it, and a number 34 to the right of the hole. If the player has the option of upgrading the fighter's card, they may choose to upgrade the fighter's Health Points from 30 to 34 by placing a peg in the hole. This signifies that the number to the right of the hole is the new upgraded Health Points. When upgrading Health Points, the HP indicator should be adjusted by the number of Health Points increased by the upgrade. Some of the items, such as the Battle Axe damage on the sample card, can be upgraded multiple times. Simply move the peg to the new hole representing the upgrade when the upgrade is performed. Items that have not been upgraded yet do not need a peg. The first number displayed to the far left is the original default value. Once a battle card is upgraded it remains that way throughout the game. In other words, a fighter who is upgraded and then defeated in battle keeps their upgrades when they are put back In Play.

Any single item on a fighter's card can be upgraded whenever the fighter Defeats another fighter in battle (depletes their Health Points below zero). Upgrades are also sometimes rewarded to Fighters through the fate cards.

Battle Card Dimensions

Each battle card is two inches in height by six inches in width. The thickness of each card is ¼ inch to allow holes in the cards where the pegs are placed. The pegs are placed into the cards to track the Health Points and upgrades of a fighter.

Magical Spells

There are several unique skills for Fighters with magical powers or spells. These additional skills are specified on the fighter's battle cards. These descriptions are provided in the "Magical Spells Reference" included with this game for easy access during the game.

Magical Spell Descriptions

Astral Project

Astral Project points represent the range that the fighter must be within from another fighter to optionally battle the other fighter. The battle is fought as though it were a range of +0 except that the attacking fighter may end the battle at any time after the opposing fighter's battle turn. If the attacking fighter wins the battle, the fighter does not advance to the position where the battle took place, but the fighter does earn an upgrade for winning the battle.

Healing

Healing points represent the range that the fighter must be within from another fighter to optionally heal some of the other fighter's Health Points. At the end of the Current Player's turn, they can choose to heal any Fighters within this range a number of Health Points determined by a single die roll if possible. A fighter can only be healed up to their maximum Health Points. A separate die must be rolled for each fighter to be healed.

Invisibility

Invisibility points represent the range that the fighter must be within from another fighter to be invisible to the other fighter to avoid a battle. Invisibility cannot be used when an opposing fighter moves within the invisibility range on the opposing player's current turn.

Protection

Protection points are used in the same manner as armor. The protection points and the armor points both reduce the amount of damage taken during battle. Not all Fighters have this feature. This is a spell or blessing that protects the fighter from damage. Usually this is common for warlocks, wizards, royalty, and holy Fighters. Some protection is also available to some Fighters for battles against specific foes. For example, a Dragon Knight is skilled in defending against dragons, and therefore will have some Dragon Protection. This specific protection can only be used to reduce damage when battling the specific type of fighter. In other words, the Dragon Protection only applies when the Dragon Knight is fighting dragons.

Teleport

Teleport points are additional movement points that can be optionally used when moving the fighter. For example, a Wizard having one movement point and a die roll of three would move three spaces. Then they could move one more space if desired due to the one movement point. If the Wizard also had two teleport points, the Wizard could optionally move (teleport themselves) two additional spaces. Unlike regular movement points, the teleport movements can move the fighter forwards or backwards. In other words, after moving the fighter the die roll amount plus any movement points, the fighter can then teleport back to a position that they had already landed on. Fighters cannot teleport backward past their Starting Positions.

Transport

Transport points represent the range that the fighter must be within from another fighter to optionally transport the other fighter to a different location on the board. At the end of the Current Player's turn, they can choose to transport any Fighters within this range a number of spaces determined by a single die roll if possible. A fighter can only be transported once per turn. A separate die must be rolled for each fighter to be transported. Fighters cannot be transported backward past their Starting Positions.

Hypnotize

Hypnotize points represent the range that the righter must be within from other Fighters to optionally hypnotize one or more of them. The hypnotized fighter attacks themself once at a range of +0 causing their health points to be reduced accordingly. The fighter casting the spell earns an upgrade if the hypnotized fighter is defeated.

Paralyze

Paralyze points represent the range that the fighter must be within from other Fighters to paralyze one or more of them during a battle. The paralyzed fighter cannot flee from battle if the attacking fighter misses.

Portal

Portal points are movement points that can be optionally used to teleport the fighter whenever they are attacked. The fighter can only teleport once per battle before the battle starts. These extra movement points may be useful in moving the fighter out of range of the attacking fighter, or moving closer to the attacking fighter to improve their own range. Fighters cannot teleport backward past their Starting Positions.

Rejuvenate

Rejuvenate points represent the number of lost Health Points that the fighter regains at the end of the Current Player's turn. A fighter can only be healed up to their maximum Health Points.

The Card of Doom

The Card of Doom determines the fate of a Chosen Fighter belonging to the Current Player. Please refer to the definition of the Chosen Fighter described in the Glossary section. If the fate rolled on the Card of Doom does not apply to the current situation or cannot be used, then it is ignored. These descriptions are provided in the "Card of Doom Reference" included with this game for easy access during the game.

Back Off

The Chosen Fighter has almost walked into a deadly trap. Roll a single die to determine the number of spaces the Chosen Fighter must back track (move back the direction they came from) if possible.

Bad Vibes

You sense bad vibes and danger in the air, and must proceed cautiously. All of your die rolls on your following turns will be treated as if you rolled a one, until you roll a six. Once a six is rolled, the roll is counted as a six and all following rolls are back to normal.

Bloodshed

You have lost a bloody battle to your enemies. Your enemies have gained valuable experience at your cost. Each of the opposing players can choose any one of their Fighters and upgrade a single item on the battle card. Refer to the Upgrading Battle Cards section for more information.

Bogus

All of the Fighters belonging to the Current Player have been Defeated in a bloody battle on level two. The Current Player must remove any of their Fighters that are on level two and take them Out of Play. This includes any Fighters belonging to the Current Player that reside in the Inner Square.

Bummer

All of the Fighters belonging to the Current Player have been Defeated in a bloody battle on level three. The Current Player must remove any of their Fighters that are on level two and take them Out of Play. This includes any Fighters belonging to the Current Player that reside in Double Trouble or Spider Lair.

Burden

Your Fighters are burdened by a lack of food and sleep. Morale is low causing them to be sluggish. None of your fighters can use any of their extra movement points or start a battle until you roll a six on a following turn.

Captured

An opposing player has just captured the Chosen Fighter. Each of the opposing players must roll a die and the highest roller captures the Chosen Fighter belonging to the Current Player. The opposing player now holds onto the captured fighter until the fighter escapes or is rescued. A player can potentially get their captured Fighters back through the Escape fate or Rescue fate on the Card of Happiness.

Chaos

Your King has betrayed you and your army. You must switch your loyalty to another King. Each of the opposing players must roll a die and the lowest roller switches Kings with the Current Player. The players switch Kings by physically swapping positions of the two Kings. This implies that each of the two players now have a new Starting Position on the game board, a new stairway leading into Sanctuary, and potentially a new direction to travel around the game board.

Death

A terrible plague has wiped out your army of Fighters. Remove all of your Fighters that are In Play from the game board except for those that have reached Sanctuary.

Deteriorate

The Chosen Fighter stepped in a strange fungus-like substance that has spread to the rest his body causing the flesh to deteriorate. Decrease the fighters Health Points to only 1.

Disease

The Chosen Fighter has caught a rare disease causing their memory to fade. They soon forget all of their recent knowledge they have gained. Remove all upgrades from the fighter's battle card.

Double Trouble

Place the Chosen Fighter into any available position within the Double Trouble trap located on the third level. Refer to the Board Layout section to identify the location of the Double Trouble trap on the game board. Up to nine Fighters can be stuck in the trap at a time. If the trap is already full, you lucked out and can ignore this fate. The fighter can escape from this trap by the player rolling doubles with the dice on one of their following turns. The player can choose to roll a single die as normal on their turn, or attempt to free their fighter from the trap by rolling two dice. To move a fighter out of Double Trouble after rolling doubles, place the fighter in the corner position of level three nearest the trap. Fighters can battle each other while they are in the Double Trouble trap.

Earthquake

The Current Player must roll a die to determine the size of the EARTHQUAKE. Starting with the Current Player and moving clockwise, each player takes a turn moving all Fighters that are In Play belonging to the opposing player to the left. Each fighter is moved the number of spaces rolled on the die if possible. If a fighter lands in a position occupied by another fighter, the fighter that it lands on is considered Defeated. This is true even if a fighter is forced to land on a fighter of the same team. Fighters can be moved in any order and any valid direction determined by the player making the moves.

Evil Darkness

A mysterious sense of doom overcomes your Fighters. An evil force of unknown origin lurks in the dark areas of the castle. Roll two dice to determine how many Health Points the evil force steals from every fighter that you have In Play. Adjust their battle cards accordingly. This, of course, does not apply to Fighters that have already made it to Sanctuary.

Flashback

The Chosen Fighter has walked into a magical portal that sends them back in time to where they began. Move the Chosen Fighter to the Starting Position. If any fighter is located in your Starting Position, that fighter is considered Defeated.

Insanity

Long battles and little sleep have confused your Fighters and driven them to the edge of insanity. The player to your left will get to take the next two of your following turns for you. In other words, they roll the dice for you, move your Fighters, fight your battles, etc. Of course, they probably will want to make some very bad decisions for you.

Last Request

The Chosen Fighter loses a battle to a magical troll. The troll is impressed by the fighter's loyalty and offers them a last request before finishing them off for good. The last requests that you may choose from are the following fates from the Card of Happiness: Bonus, Charisma, Healing, and Upgrade.

Lose a Turn

You must send your Fighters on a short journey to save a lovely maiden in distress. This is a very brave and noble gesture on your part, but you will have to take some time off from the battle to do it. Skip your next turn.

Mayhem

A powerful warlock has unleashed a magical spell causing terrible things to happen to your army. For each of your Fighters that are In Play, roll a die. The following fates from the Card of Doom apply to the fighter depending on what was rolled on the die: 1=Back Off, 2=Deteriorate, 3=Last Request, 4=Mutiny, 5=Sickness, 6=Summons.

Mutiny

The Chosen Fighter has abandoned your cause. Place the fighter in with the other mercenaries.

Plague

Your army has come down with a bad case of the plague. You must roll two dice and get doubles on one of your following turns before you can resume playing the game. Once doubles are rolled, you have revived your army and may continue to play as normal on your next turn.

Shark Attack

An opposing army has apprehended the Chosen Fighter and thrown this loyal fighter to the sharks. Place the Chosen Fighter into the Shark Attack trap. Refer to the Board Layout section to identify the location of the Shark Attack trap on the game board. Any number of Fighters can exist in the trap at the same time. To escape from the Shark Attack, a player must roll a six on the die during their turn. The die roll can only be used to move one fighter from the Shark Attack. The fighter can remain in the Shark Attack if the Current Player chooses to move a different fighter with the die roll. To move a fighter out of the Shark Attack place the fighter in the corner position on the board indicated in the Board Layout section. Fighters cannot battle each other while they are in the Shark Attack.

Sickness

The Chosen Fighter has become ill. Roll two dice to determine how many Health Points the Chosen Fighter loses fighting the sickness. Adjust their battle card accordingly.

Sin

The church has determined that you a sinner. To redeem yourself and avoid the guillotine, you must do a good deed to your enemies. Upgrade any one item on any one battle card for each of your opponents.

Snake Pit

The Chosen Fighter has fallen through a trap door in the castle and landed into a snake pit. Place the Chosen Fighter into the Snake Pit trap. Refer to the Board Layout section to identify the location of the Snake Pit trap on the game board. Any number of Fighters can exist in the trap at the same time. To escape from the Snake Pit, a player must roll a six on the die during their turn. The die roll can only be used to move one fighter from the Snake Pit. The fighter can remain in the Snake Pit if the Current Player chooses to move a different fighter with the die roll. To move a fighter out of the Snake Pit place the fighter in the corner position on the board indicated in the Board Layout section. Fighters cannot battle each other while they are in the Snake Pit.

Spider Lair

The Chosen Fighter has taken a wrong turn down a dark hallway in the castle. The Chosen Fighter lights a torch and discovers that there are hundreds of giant poisonous spiders everywhere. Place the Chosen Fighter into any available position within the Spider Lair trap. Refer to the Board Layout section to identify the location of the Spider Lair trap on the game board. Up to nine Fighters can be stuck in the trap at a time. If the trap is already full, you lucked out and can ignore this fate. To escape from the Spider Lair, a player must roll a six on the die. The die roll can only be used to move one fighter from the Spider Lair. The fighter can remain in the Spider Lair if the Current Player chooses to move a different fighter with the die roll. Fighters can battle each other while they are in the Spider Lair trap.

Summons

The Chosen Fighter notices a magical book on a dusty shelf. The fighter picks it up and opens it to a page with some strange words. After reading the words out load, the book bursts into flames and out of the smoke appears the Fire Demon spirit. The Fire Demon spirit battles the Chosen Fighter. The range for the baffle is +0 so it will be a fight to the death. The Fire Demon spirit attacks first.

Torture

One of your loyal towns people has be en captured and is being tortured by an enemy army. Roll a die to determine the number of turns that you will lose while you journey out on a rescue mission.

The Card of Happiness

The Card of Happiness determines the fate of a Chosen Fighter belonging to the Current Player. Please refer to the definition of the Chosen Fighter described in the Glossary section. If the fate rolled on the Card of Happiness does not apply to the current situation or cannot be used, then it is ignored All fates on the Card of Happiness are optional. These descriptions are provided in the "Card of Happiness Reference" included with this game for easy access during the game.

The Card of Happiness Descriptions

Blessing

A mysterious spirit rises from a pile of rubble and blesses the Chosen Fighter. Upgrade all of the weapons on their battle card to the maximum damage. Refer to the Upgrading Battle Cards section for more information.

Bonus

You may place a fighter (if available) In Play by placing it in the Starting Position, in front of your King, if it is unoccupied by one of your own Fighters. If a fighter belonging to an opposing player is occupying this Starting Position, your fighter automatically wins the battle and the opposing fighter is Defeated. Your fighter then gets an upgrade for winning the battle. Then take another turn.

Bravery

The Chosen Fighter has gained new skills due to their brave voyages. Upgrade a single item on their battle card to its maximum. Refer to the Upgrading Battle Cards section for more information.

Capture

The Chosen Fighter has just captured an enemy fighter. Opposing players must roll a die to determine if one of their Fighters will be captured. The player with the lowest die roll will have to choose any one of their Fighters to be captured, and give this fighter to the Current Player. The Current Player will hold onto the captured fighter until the fighter can escape or is rescued. A player can potentially get their captured Fighters back through the Escape fate or Rescue fate on the Card of Happiness.

Charisma

Your charisma has attracted a new follower. Select a new fighter from the remaining unselected Fighters (Mercenaries), and add them to your army.

Conquer

You have gained secret information about one of your enemies that will give you a big strategic advantage on your next battle. Automatically win your next battle once one of your fighters moves within the range of at least one of their weapons, or if you are attacked. Your fighter takes no damage and the defending fighter is Defeated.

Done Deal

Your fighter has found a secret passageway through the castle. Move the Chosen Fighter directly to Sanctuary.

Double Dice

Finish taking your current turn, then take another turn rolling two dice rather than one. Any one fighter that is In Play belonging to the Current Player will be moved the number of spaces equal to the sum of the two dice if possible. The sum of the two dice will also be treated as a single die roll. For example if the sum of the two dice equals five, the Current Player must roll for a fate card.

Ecstasy

Wandering through the castle you come across an ugly but friendly little troll who offers a choice of two magical scrolls of teleportation. The first scroll will teleport you to the mystical land of Ecstasy where life is perfect. The other scroll can be used to teleport your enemies to any other location in the castle. Due to your loyalty to your King, you choose the second scroll. Move any one of your opponent's Fighters that are In Play to any valid location on the board including the traps or Sanctuary.

Escape

Congratulations. Your Fighters have escaped from the traps of doom. If you have any Fighters trapped in the Double Trouble, Shark Attack, Snake Pit, or Spider Lair, they have escaped. You may only remove one fighter from each of these traps if they exist there. Also, all of your Fighters who were captured have escaped and are to be returned to the Current Player.

Fairy Dust

A spirit has been summoned to protect the current Chosen Fighter. The Battle Spirit will follow this fighter into battle until the fighter is Defeated, the Battle Spirit is Defeated, or the Battle Spirit befriends a different fighter. The Current Player takes the battle card for the Battle Spirit, and keeps it with the battle card for the current Chosen Fighter. Whenever this fighter gets into a battle, they get to take two turns attacking an opposing fighter. The first attack is from the fighter's own battle card, and the second is from the Battle Spirit's battle card. The defending fighter can attack back after each of the two attacks. Otherwise the battle proceeds as normal. Note that the battle is considered over once the fighter is Defeated even if the Battle Spirit is not Defeated.

Fortune

The Chosen Fighter has stumbled across a magical scroll. Not knowing what the scroll does, the fighter foolishly reads the scroll unleashing its powers. He has the good fortune of it being a good scroll. The fighter gains the one-time ability to swap positions with any other fighter on the game board. Immediately, swap the Chosen Fighter's position with any other fighter that is In Play except those in Sanctuary.

Healing

You find a mysterious orb of light. You reach to pick it up and it explodes into a rainbow of colors. Instantly all of your Fighters are healed to their maximum Health Points. Adjust their battle cards accordingly.

Health

You have taken good care of your Fighters, and they are therefore very healthy. Roll a single die to determine the number of Health Points that all of your Fighters will gain. The maximum Health Points for any single fighter is 39. Adjust their battle cards accordingly.

Honor

Do unto others as you would have done unto yourself. Choose any one of your opponents Fighters to do a good fate to. You will then gain the same fate for yourself. Choose one fate from the following fates on the Card of Happiness: Bonus, Charisma, Healing, Immortal, and Upgrade.

Immortal

A friendly wizard gives the Chosen Fighter a steamy green potion. The fighter gulps down the potion and becomes almost immortal. Increase the fighters Health points to the maximum of 39.

Invincible

The Chosen Fighter discovers a magic ring laying in the dirt. The fighter dusts it off and it begins to sparkle and light up the dimly lit castle hallway. Putting the ring on, the fighter becomes almost invincible. Upgrade all items on the fighter's battle card to their maximum.

Joy

You have tricked all of your opponents into taking a potion that hypnotizes them during their next turns. Jumping for joy, you get to take each of their next turns for them. In other words, you roll the dice for them, move their Fighters, fight their battles, etc. Of course, you probably will want to make some very bad decisions for them. It will then be your turn again.

Knight Mare

The ultimate spirit has befriended the current Chosen Fighter. The Knight Mare spirit will follow this fighter into battle until the fighter is Defeated, the Knight Mare spirit is Defeated, or the Knight Mare spirit befriends a different fighter. The Current Player takes the battle card for the Knight Mare spirit, and keeps it with the battle card for the current Chosen Fighter. Whenever this fighter gets into a battle, they get to take two turns attacking an opposing fighter. The first attack is from the fighter's own battle card, and the second is from the Knight Mare spirit's battle card. The defending fighter can attack back after each of the two attacks. Otherwise the battle proceeds as normal. Note that the battle is considered over once the fighter is Defeated even if the Knight Mare spirit is not Defeated.

Luck

You have discovered a four-leaf clover among thousands of clovers. This lucky clover provides you with even more luck. Finish taking your current turn, then take another turn rolling two dice rather than one. Any one fighter that is In Play belonging to the Current Player will be moved any number of spaces up to the number of spaces equal to the sum of the two dice if possible. The number of spaces moved will be treated as a single die roll. For example, if the Current Player moves a fighter five spaces, the Current Player must roll for a fate card.

Magic

You have gained magical powers this turn. You may use your powers for good or evil. Choose a column from either the Card of Happiness (one through three) or the Card of Doom (four through six). Choose which fighter you wish to use your magic on. You may even choose one of your own Fighters. The player owning the selected fighter then rolls two dice to determine the row within the column that was specified. The fate of the card applies to the fighter.

Power

An angel of light smiles at your good deeds. Suddenly all of your Fighters gain a powerful burst of energy. Roll a die and move each of your Fighters that are In Play the number of spaces determined by the die. Your Fighters may move any additional spaces allowed by their battle cards. Moving each fighter is optional.

Rainbow

You notice an interesting looking bottle hidden in a dark corner. You pick it up and it dissolves in your hands releasing a magic rainbow of colors that light up the entire room. The Rainbow Spirit faintly appears within the rainbow and offers to help you for releasing it. Choose any opposing fighter that is In Play and send the Rainbow Spirit to battle the opposing fighter. The range for the battle is +0 so it will be a fight to the death. The Rainbow Spirit attacks first.

Rescue

Take back all of your Fighters that have been captured by your opponents.

Revenge

Choose any one fighter on the board belonging to an opponent except for a fighter in Sanctuary, and take it Out of Play. Your opponent's fighter must now start over. This is a great opportunity to get revenge on an opponent that has been getting on your nerves or is out to get you.

Reversal

Switch your King from its current entry location to the entry location representing the opposite direction. If the King is in the King's Position, then switch to the Queen's Position. If the King is in the Queen's Position, then switch to the King's Position. If you are currently moving counter clockwise, then you will switch to moving clockwise around the board or visa versa. This is advantageous if you have Fighters that just started their journey around the board and are still close to their entry location. Now that they are going the opposite direction, they are closer to Sanctuary.

Safety

You have gained a layer of protection spell. Roll a die to determine the number of turns that the spell will effect you. You are protected from any attacks from the Fighters of opposing players during this time. None of your opponents may battle your Fighters (unless you start the battle) until the spell wears off. Also, none of your opponents may capture your Fighters until the spell wears off.

Self Esteem

Each of your opponents must give you a compliment. Hopefully this will help make up for all the rotten names they have probably been calling you during this game.

Skip Next

The army belonging to the next player is busy fighting a dragon that is threatening their territory and must take a break from the current battle at hand. Skip the next player's turn.

Sneak

You have successfully planned a sneak attack on an opposing player. Move any one of your Fighters that are In Play to any valid position on the game board that is within attacking range of an opposing fighter. Attack!

Upgrade

One of your Fighters has gone through extensive training allowing one of their attributes to be upgraded. Choose any one of your Fighters and upgrade a single item on their battle card. Refer to the Upgrading Battle Cards section for more information.

Wealth

Your greed has finally paid off. You have enough riches to tempt the finest Fighters away from their cause and join you. Choose any one fighter that is Out of Play belonging to an opponent, or one of the available Fighters (Mercenaries), and add them to your army.

Wishing Well

The Chosen Fighter tosses a coin into a mysterious looking well for good luck. Out of the depths of the well, a thundering voice offers the Chosen Fighter three wishes to be granted. The wishes that you may choose from are the following fates from the Card of Happiness: Bravery, Double Dice, Escape, Fairy Dust, Fortune, Immortal, Upgrade. Select any three of these fates.

A glossary of terms used in the game is set forth below:

Chosen Fighter

The Chosen Fighter is the fighter that the Current Player has chosen to move the number of spaces indicated on the die. Fates from the fate cards are applied to the Chosen Fighter when applicable.

Current Player

The Current Player is the player that is currently taking their turn during the game.

Defeated

A fighter is considered Defeated in a battle when they have less than one hit point left. The fighter is then taken Out of Play.

Fighters (Also known as Army Units)

Army units that move around the castle fighting battles with enemy units with the goal of reaching the center of the castle (Sanctuary). Each fighter has a battle card describing its attributes. Fighters of the same color are loyal to the same King.

Health Points (Also known as Hit Points)

The Health Points are the amount of damage that the fighter can take before they are killed in battle. When a fighter is put In Play, they start out with their total number of Health Points available. As the fighter gets into battles, their Health Points are reduced by the number of damage points they take. The Health Points are never restored unless a fighter is defeated and starts over, or the fighter visits one of the Lucky Toads. Each player must track the number of remaining Health Points that each of their Fighters has left on their battle cards. This can be done through the HP Indicator.

In Play

Any fighter that currently exists on the board is considered In Play.

Inner Square

The square level two section in the center of the game board that surrounds Sanctuary. Fighters must enter this section through the stairway protected by their King. Fighters can then enter Sanctuary from the Inner Square by the Current Player rolling a six on one of their turns.

King

Each player has a King that protects the stairway entry up to the second level to get into Sanctuary. Only Fighters that bear the same color as that of their King are allowed up the stairway. The King is placed on the game board in either the King's Position or the Queen's Position. Refer to the board layout for the location of these positions on the game board. If the King is in the player's King's Position then the player's Fighters must move clockwise around the game board. If the King is in the player's Queen's Position then the player's Fighters must move counter-clockwise around the game board. The level one position on the game board directly in front of the King determines the Starting Position where a player's Fighters are put In Play.

King's Position

Each player has a King that is placed on the game board in either the King's Position or the Queen's Position. Refer to the board layout for the location of these positions on the game board. If the King is in the player's King's Position then the player's Fighters must move clockwise around the game board.

Lucky Toads

Two Lucky Toads exist on the board on level one in opposite corners. A fighter must land on the corner position of the board directly in front of one of the Lucky Toads to be healed and regain their Health Points to their maximum. Refer to the board layout for the location of these corner positions on the game board.

Mercenaries

Mercenaries are the remaining Fighters that are left over after all players have selected their Fighters at the start of the game. These left over Fighters can be added to a player's army if the player gets the charisma fate on the Card of Happiness. Mercenaries will not be available if all of the Fighters were selected at the start of the game. Mercenaries can come in handy to a player who is short Fighters due to being captured. Refer to the Captured fate in the Card of Doom descriptions.

Out of Play

Any fighter that currently does not exist on the board is considered Out of Play.

Queen's Position

Each player has a King that is placed on the game board in either the King's Position or the Queen's Position. Refer to the board layout for the location of these positions on the game board. If the King is in the player's Queen's Position then the player's Fighters must move counter-clockwise around the game board.

Sacrifice

A game strategy where a player's fighter battles one of their own Fighters to defeat them and gain an upgrade for winning the battle.

Sanctuary

The center of the castle and game board where a predetermined number of Fighters belonging to a player must enter to takeover the castle and win the game. The Inner Square surrounds Sanctuary. A player must roll a six to move a fighter from the Inner Square into Sanctuary.

Starting Position

The level one position on the game board directly in front of the player's King determines the Starting Position where a player's Fighters are put In Play. A player must roll a one or a two to place a fighter into the Starting Position. Only one fighter may occupy this Starting Position at a time. If a fighter belonging to an opposing player is located in the Starting Position, the player may battle for the position with a fighter that they are attempting to move into that position.

From the foregoing description, it will be understood that the medieval castle board game and kit therefor and the methods of playing the medieval castle board game of the present invention, have a number of advantages, some of which have been described above and others of which are inherent in the invention. Also, modifications can be made to the game kit and method of playing the game without departing from the teachings of the invention. Accordingly, the scope of the invention is only to be limited as necessitated by the accompanying claims.

I claim:

1. A game kit for a board game comprising a game board sub-divided into aliquot area locations or spaces and having at least three levels including ground level locations, second level locations and third level locations, at least one ground level location being situated between two second level locations on the board requiring a player on a second level to jump across a ground level location to another second level location, and at least one stairway between the three levels, at least one die, at least two fighter pieces, a unique battle card for each piece providing different strengths and weaknesses for the piece and under, certain conditions, enabling the strengths and weaknesses for the piece to be upgraded or downgraded, and at least two fate cards one of which is required to be picked when a predetermine number on the at least one die is rolled, the two fate cards including a "card of happiness" and a "card of doom" each requiring three die tosses to determine a fate.

2. The game kit of claim 1 wherein said game board levels are in the form of walls of a castle.

3. The game kit of claim 1 including at least eight fighter pieces, four fighter pieces per player and a unique battle card for each fighter piece indicating the strengths, weaknesses, limitations and capabilities of each particular fighter piece.

4. The game kit of claim 1 including at least sixteen fighter pieces, four pieces for each one of four players, and a unique battle card for each fighter piece indicating the strengths, weaknesses, limitations and capabilities of each particular fighter piece.

5. The game kit of claim 1 wherein said die is constructed for one of (a) being thrown for determining the steps or spaces on the board which a fighter piece of a player can move between locations on the board, (b) for being thrown when a battle is established between fighter pieces and (c) for being thrown for selecting a fate on the fate cards.

6. The game kit of claim 1 including two additional dies for being thrown with the first named die to determine a fate from a fate card.

7. The game kit of claim 1 wherein the number of locations or spaces between spaced apart same levels determine the number a player has to roll on the die to jump from a location or space on one level to a location or space on a closely adjacent same level.

8. The game kit of claim 7 wherein said third level positions are separated from each other by at least two locations or spaces.

9. The game kit of claim 1 wherein said battle cards are three dimensional to permit pegs to be inserted in, and held in, holes in the card for tracking or upgrading or downgrading.

10. The game kit of claim 1 wherein each battle card provides for different weapons for use at different distances and for upgrading or downgrading the power or strength level of the weapon.

11. The game kit of claim 1 wherein each fate cards are weighted so that depending on the roll of three die, a real good fate or a real bad fate is harder to obtain.

12. The game kit of claim 1 wherein each battle card has ungradable or downgradeable movement points such that the associated fighter piece can be moved more or less than the number rolled with a die.

13. The game kit of claim 1 wherein each fighter piece can battle with other fighter pieces at different distances depending on the type and power or strength level of the weapon established on the associated battle card by the number obtained on a roll of the die.

14. A method for playing a medieval castle board game including a game board sub-divided into aliquot area locations or spaces and having at least three levels including ground level locations, second level locations and third level locations, at least one ground level location being situated between two second level locations on the board requiring a player on a second level to jump across a ground level location to another second level location, and at least one stairway between the three levels, at least one die, at least two fighter pieces, a unique battle card for each piece providing different strengths and weaknesses for the piece and under, certain conditions, enabling the strengths and weaknesses for the piece to be upgraded or downgraded, and at least two fate cards one of which is required to be picked when a predetermine number on the at least one die is rolled, the two fate cards including a "card of happiness" and a "card of doom" each requiring three die tosses to determine a fate comprising the steps of:

rolling the die to determine which player goes first;

each player then sequentially rolling the die to determine the number of locations or spaces the player can move his fighter piece between the locations or spaces on the respective three levels on the board;

when a predetermine number on the at least one die is rolled, throwing three die tosses to determine a fate; and, sequentially moving the fighting piece around the board until it is positioned to do battle with another fighting piece or it reaches a sanctuary.

15. The method of claim 14 wherein the game includes a plurality of fighter pieces and a battle card for each fighter piece, each battle card indicating the strengths, weaknesses, limitations and other capabilities of the particular fighting piece.

16. A game kit for a board game comprising at least one die, at least two fighter pieces, a unique battle card for each fighter piece and a game board sub-divided into aliquot area locations or spaces and having at least two levels including ground level locations and second level locations, at least one ground level location being situated between the second level locations on the board requiring a player on a second level location to jump across a ground level location of one or more spaces to another second level location upon throwing a number on the die greater than the number of spaces between a second level location having a fighter piece and an spaced, adjacent second level location, and at least one stairway between the two levels.

17. The game kit of claim 16 wherein said at least two levels of said game board are in the form of walls of a castle.

18. A method for playing a board game including a game board sub-divided into aliquot area locations or spaces and having a t least three levels including ground level locations, second level locations and third level locations, at least one ground level location being situated between two second level locations and between two third level locations on the board requiring a player on a second level location to jump across a ground level location to another second level location and requiring a player on a third level location to jump across a ground level location to another third level location, and at least one stairway between the three levels, at least one die, and at least two fighter pieces, and a unique battle card for each fighter piece, comprising the steps of:

rolling the die to determine which player goes first;

each player then sequentially rolling the die to determine the number of locations or spaces the player can move his fighter piece between the locations or spaces on the respective three levels on the board; and, sequentially moving the fighting piece around the board until it is positioned to do battle with another fighting piece or until it reaches a sanctuary.

19. In a board game including at least one die, two playing pieces, a battle card for each playing piece and a game board, the improvement residing in the provision of a three dimensional game board having walls extending upward to at least a second level and playing pieces representing characters that can jump across one or more spaces between adjacent walls of equal height upon throwing one or more die for a number greater than the number of spaces between the walls of equal height.

* * * * *